US007260181B2

(12) United States Patent
McDonald et al.

(10) Patent No.: US 7,260,181 B2
(45) Date of Patent: Aug. 21, 2007

(54) ENHANCED ELECTRON BACKSCATTERING IN X-RAY TUBES

(75) Inventors: James L. McDonald, Naperville, IL (US); Allan D. Kautz, Naperville, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/558,767

(22) PCT Filed: May 12, 2004

(86) PCT No.: PCT/IB2004/001725

§ 371 (c)(1),
(2), (4) Date: Nov. 30, 2005

(87) PCT Pub. No.: WO2004/107384

PCT Pub. Date: Dec. 9, 2004

(65) Prior Publication Data

US 2007/0025517 A1 Feb. 1, 2007

Related U.S. Application Data

(60) Provisional application No. 60/474,737, filed on May 30, 2003.

(51) Int. Cl.
*H01J 35/18* (2006.01)

(52) U.S. Cl. ..... 378/140; 378/141

(58) Field of Classification Search ..... 378/127, 378/128, 140, 141, 142
See application file for complete search history.

(56) References Cited

U.S. PATENT DOCUMENTS

| | | | | |
|---|---|---|---|---|
| 4,339,687 | A | 7/1982 | Redington | 313/402 |
| 4,468,802 | A | 8/1984 | Friedel et al. | 378/140 |
| 4,731,804 | A | 3/1988 | Jenkins | 378/140 |
| 5,206,895 | A | 4/1993 | Danos | 378/121 |
| 5,511,104 | A | 4/1996 | Mueller et al. | 378/125 |
| 5,689,541 | A | 11/1997 | Schardt | 378/140 |
| 5,768,338 | A | 6/1998 | Kuroda et al. | 378/143 |

(Continued)

FOREIGN PATENT DOCUMENTS

DE 100 23 356 A1 11/2001

(Continued)

OTHER PUBLICATIONS

Holliday, J.E., et al.; Backscattering of 5-20 kev Electrons from Insulators and Metals; 1957; Journal of Applied Physics; 28(10)pp. 1189-1193.

*Primary Examiner*—Hoon Song

(57) ABSTRACT

An x-ray tube (24) includes an anode (42) defining a target. A cathode assembly (40) is in operative relationship with the anode to produce x-rays (56). An evacuated envelope (35) encloses the anode and cathode. The evacuated envelope includes a metal frame portion (39). The material comprising the metal frame portion has a backscatter coefficient. An x-ray transmissive window (41) is joined in a vacuum tight manner to the metal frame portion of the evacuated envelope. The material comprising the x-ray transmissive window has a backscatter coefficient. A backscatter layer (90) is deposited on the x-ray transmissive window and the metal frame portion of the evacuated envelope around the x-ray transmissive window. The backscatter layer has a backscatter coefficient greater than the backscatter coefficient of both of the window and the metal frame.

14 Claims, 4 Drawing Sheets

U.S. PATENT DOCUMENTS

| | | | | |
|---|---|---|---|---|
| 5,828,727 | A | 10/1998 | Schild | 378/140 |
| 5,987,097 | A | 11/1999 | Salasoo | 378/141 |
| 5,995,585 | A | 11/1999 | Salasoo | 378/137 |
| 6,005,918 | A | 12/1999 | Harris | 378/140 |
| 6,118,852 | A * | 9/2000 | Rogers et al. | 378/140 |
| 6,487,272 | B1 * | 11/2002 | Kutsuzawa | 378/140 |

FOREIGN PATENT DOCUMENTS

| | | |
|---|---|---|
| EP | 0 491 471 A2 | 6/1992 |
| EP | 0 991 106 A2 | 4/2000 |
| JP | 7-230892 | 8/1995 |
| WO | WO 02/35574 A1 | 5/2002 |

* cited by examiner

ENHANCED ELECTRON BACKSCATTERING IN X-RAY TUBES

CROSS REFERENCE TO RELATED APPLICATIONS

This application claims the benefit of U.S. provisional application Ser. No. 60/474,737 filed May 30, 2003, which is incorporated herein by reference.

The present invention relates to metal frame x-ray tubes and is particularly related to an x-ray tube adapted to reduce heating of an x-ray transmissive window and the metal frame around the window. The present invention finds application in conjunction with medical diagnostic imaging systems and will be described with particular respect thereto.

Conventional medical diagnostic imaging systems use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are electrically reconstructed from x-rays produced by a high powered x-ray tube rotated about a patient's body.

The x-ray tube assembly typically comprises a lead lined housing containing a vacuum envelope or x-ray insert which holds a rotating anode and a stationary cathode. The x-ray insert may be a metal shell or frame with a beryllium x-ray transmissive window mounted or brazed thereon for allowing the transmission of x-rays from the x-ray insert. Likewise, an x-ray output window is defined in the housing that is in alignment with the beryllium window of the x-ray insert such that x-rays may pass directly through the beryllium window and the x-ray output window. Cooling oil is circulated between the x-ray insert and the housing.

Typically, the cathode has a cathode filament through which a heating current is passed. This current heats the filament sufficiently that a cloud of electrons is emitted, i.e. thermionic emission occurs. A high potential, on the order of 100-200 kV, is applied between the cathode and anode located in the evacuated envelope. This potential causes the electrons to flow from the cathode to the anode through the evacuated region in the interior of the envelope. A cathode focusing cup housing the cathode filament focuses the electrons onto a small area or focal spot on the anode. The electron beam impinges the anode with sufficient energy that x-rays are generated. A portion of the x-rays generated pass through the x-ray transmissive window of the envelope to a beam limiting device, or collimator, attached to an x-ray tube housing. The beam limiting device regulates the size and shape of the x-ray beam directed toward a patient or subject under examination thereby allowing images of the patient or subject to be reconstructed.

During the production of x-rays, when the beam of primary electrons strikes the surface of the target of the anode, a fraction of the electrons penetrate into the solid and interact with the lattice nuclei and electrons of the target material. This produces excitation and ionization, principally by interaction with outer shell electrons. Electrons freed within the solid by this process move toward the surface and a fraction of these electrons will escape as true secondary electrons. True secondary electrons typically have an energy level of only a few eV. Typically, electrons with energy levels less than 50 eV are referred to as secondary electrons. It also is possible that a primary electron which has lost a portion of its energy inside the solid, is scattered back to the surface. If such a primary electron has sufficient energy remaining, it may climb the potential barrier at the surface and escape as a result of Rutherford scattering. In addition, a fraction of the primary electrons are elastically scattered from the solid surface. Electrons that fall within the latter two categories have energies between 50 eV and the primary energy level of the electron beam.

One may distinguish between these three identified categories of electrons leaving the surface as (i) elastically-reflected primary electrons, (ii) in-elastically reflected primary electrons and (iii) true secondary electrons. Categories (i) and (ii) are commonly referred to as backscattered electrons.

For electron energy above 30 keV, energy loss from the target material by true secondary electron emission is negligible. The energy loss by backscattered electrons in categories (i) and (ii) is more significant for x-ray transmissive window and frame heating in an X-ray tube. Heating around the window area of a metal frame x-ray tube caused by these backscattered electrons is a factor that limits the operation of a metal frame x-ray tube at higher power levels.

These electrons, backscattered from the target, may have energies between 50 eV and full cathode potential. However, typical backscattered electrons have about one-half the energy of the primary beam electrons. These electrons strike other regions of the x-ray tube. A significant fraction of them are reflected or accelerated toward, and subsequently strike, the grounded x-ray transmissive window and the metal tube envelope (or frame) surrounding the window. Some electrons are accelerated by virtue of a force derived from the full cathode potential.

When an electron, either backscattered from the target or emitted directly from the cathode filament, suffers an inelastic collision with the window/frame, its kinetic energy is converted to heat which can lead to heating of the window and surrounding frame.

The x-ray transmissive beryllium window receives the highest intensity of the backscattered and secondary electron heating because the window is closer to the focal spot on the anode. When the window is not sufficiently cooled, the heat can damage the braze joint between the x-ray transmissive window and the metal frame of the x-ray insert causing the x-ray tube to fail. In addition, the coolant adjacent to the window may boil and leave a carbon residue on the window. Such a coating is undesirable as it may degrade the quality of the x-ray image.

With an ongoing desire to provide x-ray tubes producing higher power exposures and shorter imaging times, the intensity of the electron beam striking the anode continues to increase. Unfortunately, this in turn has caused the amount of secondary and backscatter electron bombardment to increase thereby making it difficult to provide a reliable air tight junction between the window and the metal envelope.

One known method of reducing the amount of secondary electron bombardment occurring at a junction between the window and the metal frame is described in U.S. Pat. No. 5,511,104 assigned to Siemens Aktiengesellschaft. The '104 Patent provides a first electrode at anode potential and a second electrode at cathode potential positioned such that secondary electrons emanating from the anode must pass through a space between the first and second electrodes in order to reach the window. As secondary electrons passing through the space are attracted to the electrode at anode potential, fewer secondary and backscatter electrons reach the window thus reducing heating at the junction between the window and the envelope. One drawback to the '104 patent is that x-ray tubes configured with this design are typically limited to single ended designs where the anode is at ground potential and the cathode is at −150,000 volts, for example. If a bi-polar arrangement is used in conjunction with the design described in the '104 patent, where the anode was at a positive voltage potential (i.e. +75,000 volts), and the cathode was at a negative voltage potential (i.e. −75,000 volts) it is difficult to position the electrodes such that arcing does not occur between the electrodes and the anode and/or the cathode.

Therefore, what is needed is an apparatus for reducing the amount of heating resulting from backscattered and secondary electron bombardment at the window and a metal frame envelope which overcomes the shortfall described above.

If a larger portion of the electrons incident on the window and the frame surrounding the window could be made to reflect as re-backscattered electrons, the kinetic energy of these electrons, converted into heat in the frame, could be reduced. The present invention is directed to an x-ray tube structure that satisfies the need to provide an x-ray transmissive window area which has reduced localized heating due to backscattered electrons during x-ray generation.

An apparatus applying principles of the present invention includes an x-ray tube with an anode defining a target and a cathode assembly in operative relationship with the anode to produce x-rays. An evacuated envelope encloses the anode and cathode. The evacuated envelope includes a metal frame portion. The material comprising the metal frame portion has a backscatter coefficient. An x-ray transmissive window is joined in a vacuum tight manner to the metal frame portion of the evacuated envelope. The material comprising the x-ray transmissive window has a backscatter coefficient. A backscatter layer is deposited on the window and the metal frame portion of the evacuated envelope around the x-ray transmissive window. The backscatter layer has a backscatter coefficient greater than the backscatter coefficient of both of the window and the metal frame.

In accordance with another aspect of an apparatus applying principles of the present invention, the material comprising the backscatter layer has an atomic number (Z) of at least 35.

In accordance with another aspect of an apparatus applying principles of the present invention, the material comprising the backscatter layer has a backscatter coefficient of at least 0.40.

Another aspect of an apparatus applying principles of the present invention maintains the transmission of x-rays through the x-ray transmissive window above a predetermined threshold value for the combined attenuation due to the x-ray transmissive window and the attenuation due to the backscatter layer.

In accordance with yet another aspect applying principles of the present invention the thickness of the backscatter layer applied to the x-ray transmissive window is at least 1 micron. In a more limited aspect of an apparatus practicing principles of the present invention the thickness of the backscatter layer applied to the x-ray transmissive window is less than 9.5 microns.

One advantage of the present invention is that the that it reduces localized heating of the window area during x-ray tube operation.

Another advantage of the present invention is the life of the x-ray tube is improved.

Yet a further advantage of the present invention is that the reliability and performance of the x-ray tube is improved.

An apparatus and method applying principles of the present invention provides the foregoing and other features hereinafter described and particularly pointed out in the claims. The following description and accompanying drawings set forth certain illustrative embodiments applying principles of the present invention. It is to be appreciated that different embodiments applying principles of the invention may take form in various components and arrangements of components. These described embodiments being indicative of but a few of the various ways in which the principles of the invention may be employed. The drawings are only for the purpose of illustrating a preferred embodiment of an apparatus applying principles of the present invention and are not to be construed as limiting the invention.

The foregoing and other features and advantages of the present invention will become apparent to those skilled in the art to which the present invention relates upon consideration of the following detailed description of a preferred embodiment of the invention with reference to the accompanying drawings, wherein.

Figure 3:
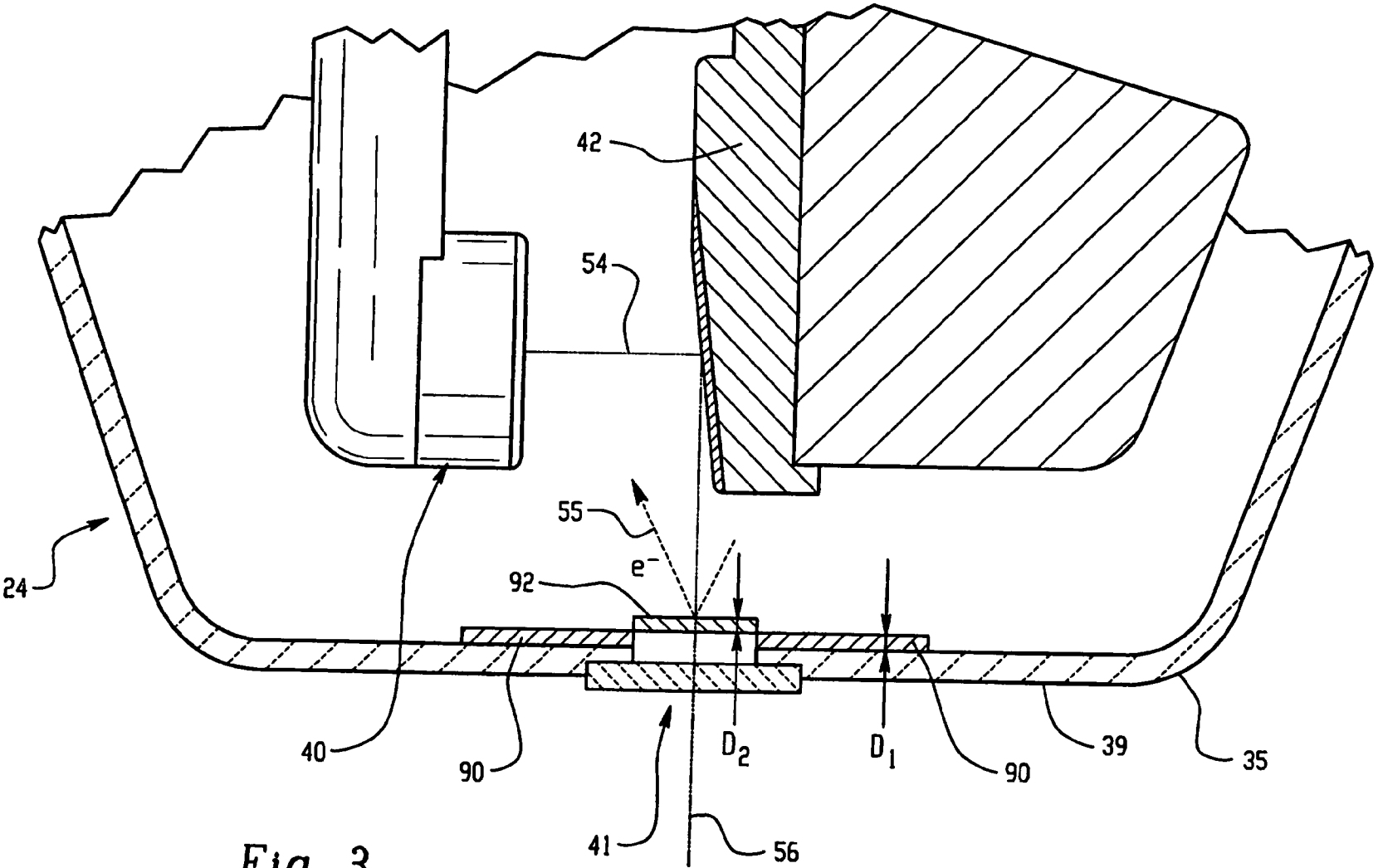
Figure 4:
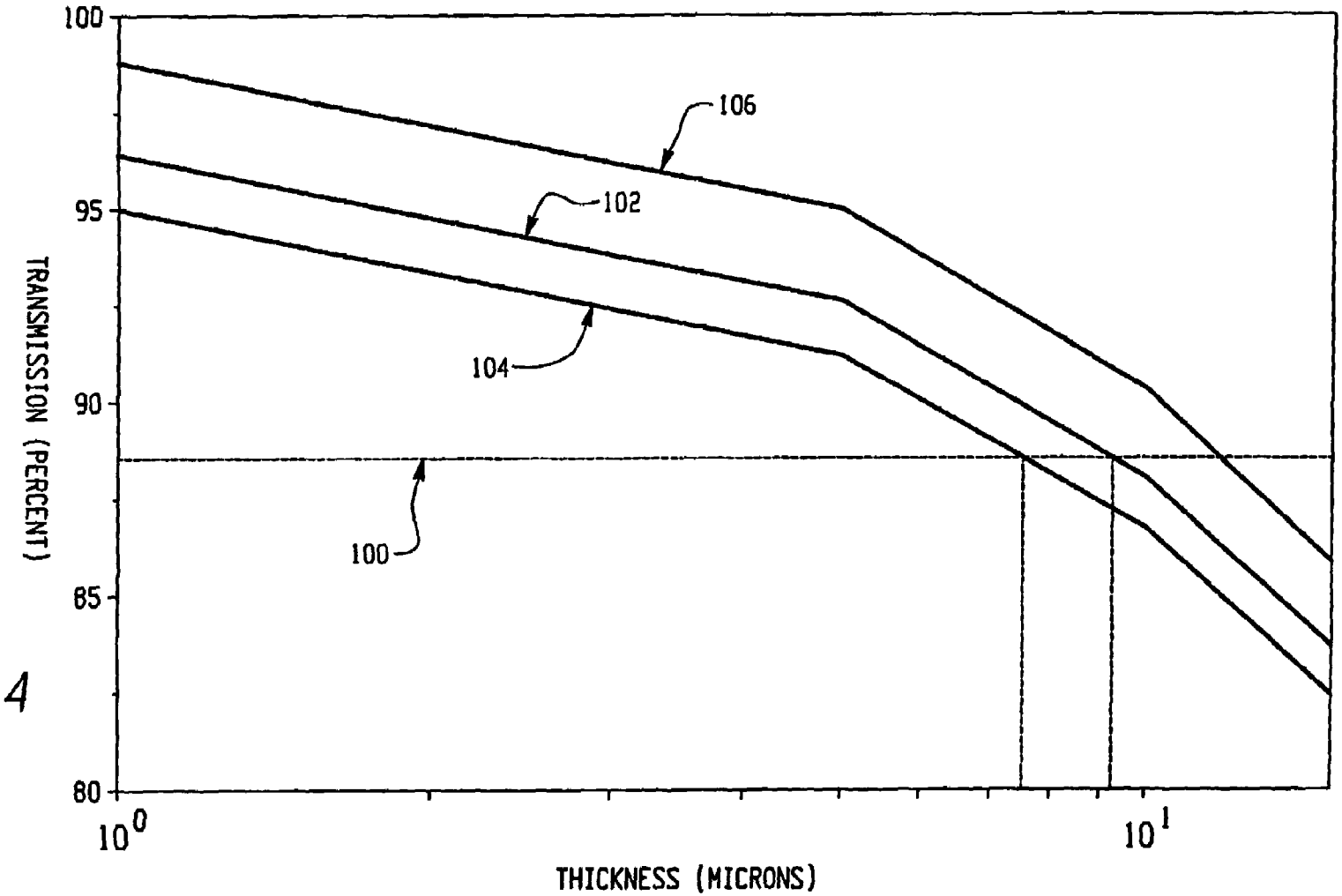

FIG. 3 is another view of a partial sectional schematic representation of an x-ray tube applying principles of the present invention; and FIG. 4 is a graphical representation of x-ray transmission characteristics of materials as a function of tungsten thickness having application with respect to examples of some x-ray transmission window materials for an apparatus applying principles of the present invention.

Figure 1:
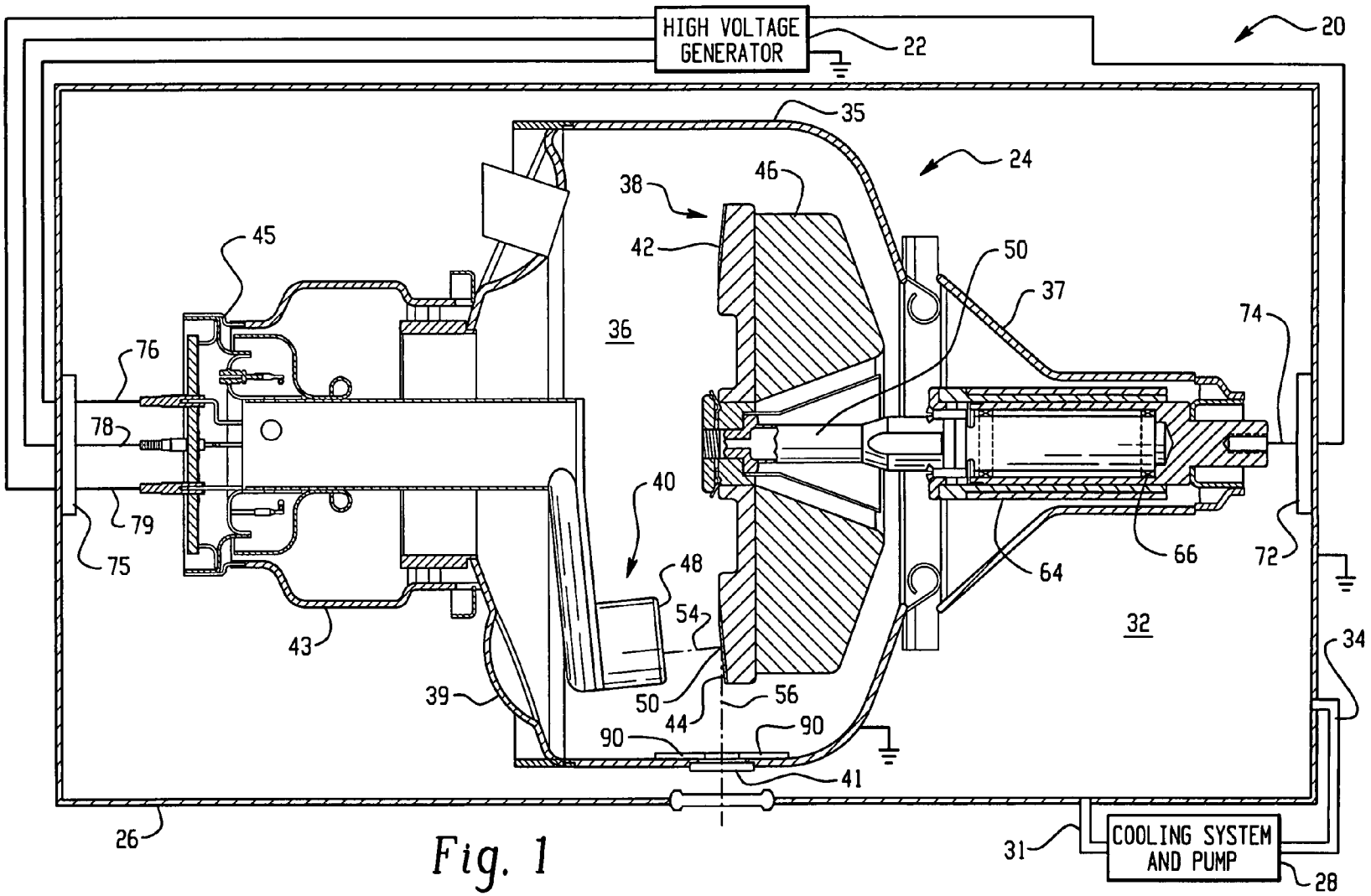
FIG. 1 is a schematic sectional representation of an x-ray tube system applying principles of the present invention.

With reference to FIG. 1, an x-ray tube system 20 is shown illustrating aspects of the present invention. The system 20 includes a high voltage power supply 22, an x-ray tube 24 mounted within a housing 26 and a heat exchanger 28. The x-ray tube 24, also commonly referred to as an insert, is securely mounted with tube supports (not shown) in a conventional manner within the x-ray tube housing 26. The housing 26 is filled with a cooling fluid, for example a dielectric electrical insulating oil, having high electrical resistance. However, it will be appreciated that other suitable insulating and cooling fluid/medium could alternatively be used. The oil is pumped through a supply line 31 into a chamber 32, defined by the x-ray tube housing 26, which surrounds the x-ray tube 24. The pumped oil absorbs heat from the x-ray tube 24 and exits the housing 26 through a return line 34 connected to the heat exchanger 28 disposed outside the x-ray tube housing 26. The heat exchanger 28 includes cooling fluid pump (not shown).

The x-ray tube 24 includes an evacuated envelope 35 defining an evacuated chamber 36. In some higher power x-ray tubes, the envelope 35 can be made of glass in combination with other suitable materials including ceramics and metals. For example, an anode wall portion 37 is comprised of metal, such as copper, stainless steel or other suitable metal. The center wall portion 39 is also comprised of a like suitable metal and has an x-ray transmissive window 41. The x-ray transmissive window 41 may be comprised of Beryllium, Titanium or alternatively another known suitable x-ray transparent material. A cathode wall portion 43 is comprised of glass or other suitable ceramic material.

Disposed within the envelope 35 is an anode assembly 38 and a cathode assembly 40. The anode assembly 38 includes a circular target substrate 42 having a focal track 44 along a peripheral edge of the target 42. The focal track 44 is comprised of a tungsten alloy or other suitable material capable of producing x-rays when bombarded with electrons. The anode assembly 38 further includes a back plate 46 made of graphite to aid in cooling the target 42.

The anode assembly 38 includes a bearing assembly 66 for rotatably supporting the target 42. The target 42 is mounted to a rotor stem 58 in a manner known in the art. The rotor stem 58 is connected to a rotor body 64 which is rotated during operation about an axis of rotation by an electrical stator (not shown). The rotor body 64 houses the bearing assembly 66 which provides support thereto.

The cathode assembly 40 is stationary in nature and includes a cathode focusing cup 48 operatively positioned in a spaced relationship with respect to the focal track 44 for focusing electrons to a focal spot 50 on the focal track 44. A cathode filament (not shown) mounted to the cathode focusing cup 48 is energized to emit electrons 54 which are accelerated to the focal spot 50 to produce x-rays 56.

The power supply 22 provides high voltage of 70 kV to 100 kV to the anode assembly 38 through an anode socket 72 and conductor 74 located within the cooling fluid filled housing 26. The socket 72 and conductor 74 are suitable for providing electrical connections for the operating voltage of the anode.

The cathode assembly 40 is suitably connected to the power supply 22 with a cathode socket 75 and conductors 76, 78, 79, to provide necessary operating power to the cathode assembly 40 for the x-ray tube, typically −70 kV to −100 kv. Alternatively, the anode end may be held at ground or common potential and a suitable high voltage applied to only the cathode components for proper x-ray tube operation.

As described above, during x-ray tube operation, secondary and backscattered electrons (hereinafter also collectively referred to as "backscattered electrons") are present and strike the x-ray transmissive window as well as the metal frame around the window. When an electron, either backscattered from the target or emitted directly from the cathode filament, has an inelastic collision with the window or frame, the electron's kinetic energy is converted to heat which can lead to undesired increased heating of the window and surrounding frame. The increased localized heating can cause the joint securing the window in the frame to lose integrity and negatively impact tube performance or life.

Figure 2:
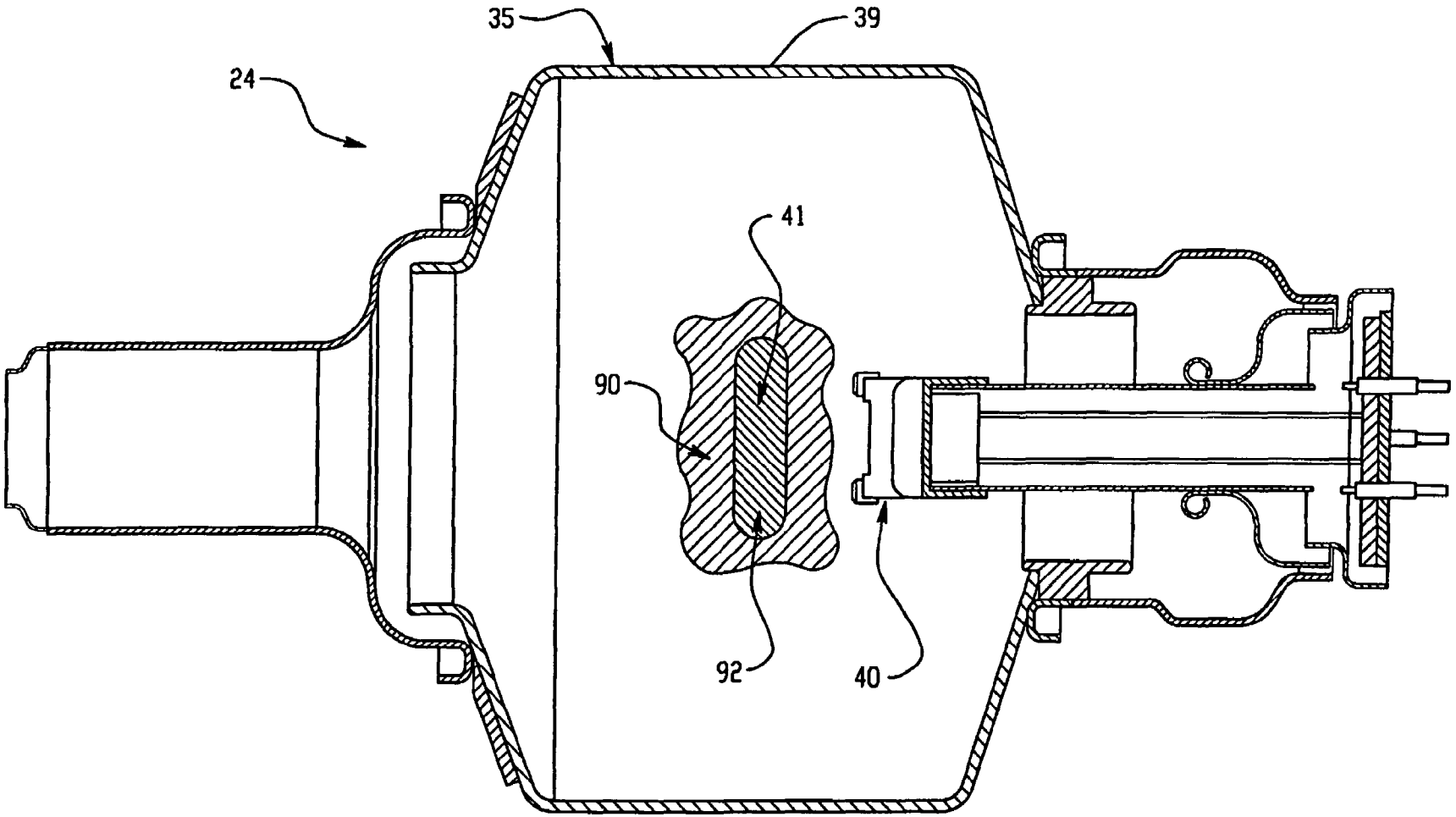
FIG. 2 is a partial sectional schematic representation of an x-ray tube applying principles of the present invention.

Referring to FIGS. 2 &3, in accordance with aspects of the present invention, a backscatter layer 90 of a high atomic number (Z) material with a backscattering coefficient greater than the backscatter coefficient for the window and the frame material is deposited on the inner (vacuum) surface both of the window 41 and the frame 39. The electron backscatter coefficient is the probability of an electron incident on a surface leaving the surface upon striking it. The coefficient is expressed as a ratio of the electrons leaving the surface relative to those incident to the surface. As described above, the metal frame may be copper, having an approximate backscatter coefficient of 0.34, or stainless steel estimated to have an approximate backscatter coefficient similar to iron of 0.25 to 0.3. Typically beryllium or titanium comprise the window. The backscatter coefficients Beryllium is 0.04 and Titanium is 0.25. It is to be appreciated that other suitable materials may be used for the window.

Two examples of suitable high Z materials for the backscatter layer 90 are Tungsten (Z=74), having an approximate backscatter coefficient of 0.47, or gold (Z=79) having an approximate backscatter coefficient of 0.40. In addition, materials such as Molybdenum (Z=43) and Platinum (Z=78) may be suitable for some applications. The backscatter layer 90 may be applied by known deposition techniques such as electrostatically, sputtering, flame spraying, evaporation or other suitable technique which provides for relatively uniform application of the deposit of the backscatter layer 90 on the window 41 and the metal frame 39 around the window.

The backscatter layer 90 is applied as described above to provide uniformity for the layer 90 since imperfections in the path of the x-rays 56 exiting through the x-ray transmissive window 41 may create artifacts in an x-ray image. In addition, an excessively thick laminate layer may undesirably attenuate the x-rays directed to the patient through the window and negatively impact the image. It is desirable to improve the backscatter properties of the window 41 with as little increase in image artifacts as commercially and clinically reasonable and to limit attenuation the of transmission of x-rays through the window to an acceptable level.

The addition of a suitable backscatter layer 90 of tungsten over the copper frame portion can increase the number of electrons backscattered from the frame area around the window by approximately 13%. This reduces the incident electron energy transferred to the window and converted to heat. A tungsten film thickness of one micron is sufficient to prevent 60 keV electrons from penetrating the film and transferring their energy in the form of heat to the metal frame.

When the maximum depth of penetration of a backscatter electron from the anode is less than or equal to the film thickness $D_1$ for the backscatter layer 90 applied to the frame and $D_2$ for the backscatter layer applied to the window (FIG. 3), the electrons are reflected, i.e. are re-backscattered, from the respective layer/laminate according to its backscattering coefficient. In the instance where the maximum depth of electron penetration is greater than $D_1$ or $D_2$, the backscatter coefficient approaches that of the substrate material, i.e. the frame or window.

In the present invention, the respective backscatter layer 90 is of sufficient thickness to reduce the quantity of electrons within a particular energy range from penetrating completely through to the frame or window. Hence, the backscattering coefficient around the window area and for the window is that of the respective layer and not the respective coefficient of the frame/window. The re-backscattered electrons are not absorbed within the window/frame and localized window/frame heating is reduced.

However, the thickness $D_2$ of the backscatter laminate 92 is also selected to result in satisfying a lower threshold amount of x-ray attenuation. More specifically, it is desirable to limit the x-ray beam attenuation due to the x-ray window 41 and the backscatter layer 90 to an attenuation value similar to the thickness of 2.5 mm of aluminum. This limit corresponds to an approximate thickness of about 9.5 microns of tungsten on a beryllium window, as described below, and approximately 8.0 microns on a titanium window, also described below.

FIG. 4 shows a graphical representation of a reduction in x-ray beam transmission percentage as a function of tungsten coating thickness on two examples of x-ray transmissive window materials, e.g. beryllium and titanium. Similar transmission attenuation relationships exist for other suitable dimensions and material combinations for the window and backscatter material. The threshold value for this graphical representation is shown by a line 100 which represents transmission of 88.5% of the generated x-rays incident to the window and corresponds to a thickness of 2.5 mm of aluminum. In this representation, the line 102 represents the change in x-ray transmission for a beryllium window with a tungsten backscatter layer. The line 104 similarly represents a titanium window with a tungsten backscatter layer. A line 106 represents the change in x-ray transmission for the tungsten backscatter material alone.

The beryllium window for the representation in FIG. 4 has a window thickness of 0.102 cm, an attenuation coefficient at 93 KeV of 1357 $cm^2/gm$ and a nominal density of 1.845 $gm/cm^3$. For the titanium window, the window thickness is 0.030 cm, the attenuation coefficient at 93 KeV is 0.3006 $cm^2/gm$ and it has a nominal density of 4.53 $gm/cm^3$. The tungsten backscatter material has an attenuation coefficient at 93 KeV of 5.2412 $cm^2/gm$ and a nominal density of 19.3 $gm/cm^3$. The x-ray transmission line 104 illustrates that a thickness of 8.0 microns for the tungsten layer in combination with the titanium window satisfies the transmission lower limit shown by line 100. The x-ray transmission line 102 illustrates that a thickness of 9.5 microns for the tungsten layer in combination with the beryllium window satisfies the transmission lower limit shown by line 100. It is to be appreciated that different thickness of x-ray transmissive window, backscatter layer and reduction in transmission limit may be used in accordance with the principles of the present invention and the present invention is not limited to the recited specific examples indicated above.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

The invention claimed is:

1. An x-ray tube comprising:

an anode defining a target;

a cathode in operative relationship with the anode to produce x-rays;

an evacuated envelope enclosing the anode and cathode, the evacuated envelope including a metal frame portion, the metal frame portion having a metal frame portion backscatter coefficient;

an x-ray transmissive window joined in a vacuum tight manner to the metal frame portion of the evacuated envelope, the x-ray transmissive window having a window material backscatter coefficient; and a backscatter layer deposited on both (i) an inner vacuum surface of the x-ray transmissive window including a region of the x-ray transmissive window corresponding to a path for desired x-rays to exit through and (ii) an inner vacuum surface of the metal frame portion of the evacuated envelope around the x-ray transmissive window, the backscatter layer having a backscatter coefficient greater than the backscatter coefficient of both of the x-ray transmissive window and the metal frame, and the backscatter layer further being configured to re-direct backscattered electrons generated during x-ray generation to not be absorbed within (i) the x-ray transmissive window or (ii) the metal frame portion of the evacuated envelope around the x-ray transmissive window.

2. The x-ray tube of claim 1 wherein the backscatter layer is deposited by at least one of electrostatic deposit, sputtering, flame spraying and evaporation.

3. The x-ray tube of claim 1 wherein the material comprising the deposited backscatter layer has an atomic number of at least 35.

4. The x-ray tube of claim 1 wherein the material comprising the deposited backscatter layer has a backscatter coefficient of at least 0.40.

5. The x-ray tube of claim 1 wherein the transmission percentage of x-rays through the x-ray transmissive window for the combined attenuation due to the x-ray transmissive window and the attenuation due to the backscatter layer is above a predetermined threshold percentage value.

6. The x-ray tube of claim 1 wherein the thickness of the backscatter layer applied to the x-ray transmissive window is at least 1 micron.

7. The x-ray tube of claim 6 wherein the thickness of the backscatter layer applied to the x-ray transmissive window is less than 9.5 microns.

8. The x-ray tube of claim 1 wherein the thickness of the backscatter layer applied to the metal frame is at least 1 micron.

9. The x-ray tube of claim 1 wherein at least 88.5 percent of the x-rays incident on the window pass through the window.

10. An x-ray tube comprising:

an x-ray generation source contained within a housing;

a window in said housing, said window allowing x-rays to be directed from said x-ray housing; and a backscatter layer located between said x-ray generation source and said window, the backscatter layer being deposited on both (i) an inner vacuum surface of the x-ray transmissive window including a region of the x-ray transmissive window corresponding to a path for desired x-rays to exit through and (ii) an inner vacuum surface of the housing around the x-ray transmissive window, the backscatter layer having a backscatter coefficient greater than the backscatter coefficient of both of the x-ray transmissive window and the housing, and the backscatter layer further being configured to re-direct backscattered electrons generated during x-ray generation to not be absorbed within (i) the x-ray transmissive window or (ii) the portion of the housing around the x-ray transmissive window.

11. The x-ray tube of claim 10 wherein the backscatter layer has a backscatter coefficient of at least 0.40.

12. The x-ray tube of claim 10 wherein the thickness of the backscatterer layer is between 1 micron and about 9.5 microns.

13. The x-ray tube of claim 10 wherein the transmission percentage of x-rays through the window is above a predetermined threshold percentage value.

14. An x-ray tube comprising:

an anode defining a target;

a cathode in operative relationship with the anode to produce x-rays;

an evacuated envelope enclosing the anode and cathode, the evacuated envelope including a metal frame portion;

a window forming a portion of the metal frame portion of the evacuated envelope; and a layer located proximate to said window, said layer having a backscatter coefficient of at least 0.40, thereby redirecting a portion of the x-rays away from the window, wherein the layer further comprises a backscatter layer deposited on both (i) an inner vacuum surface of the window including a region of the window corresponding to a path for desired x-rays to exit through and (ii) an inner vacuum surface of the metal frame portion of the evacuated envelope around the window, the backscatter layer having a backscatter coefficient greater than a backscatter coefficient of both of the window and the metal frame portion, and the backscatter layer further being configured to re-direct backscattered electrons generated during x-ray generation to not be absorbed within (i) the window or (ii) the metal frame portion of the evacuated envelope around the window.

* * * * *